US007621833B2

(12) United States Patent
Proulx et al.

(10) Patent No.: US 7,621,833 B2
(45) Date of Patent: Nov. 24, 2009

(54) HOCKEY PUCK

(76) Inventors: Hugo Proulx, 1910 Fairmeadows Dr., Bettendorf, IA (US) 52722; Anthony L. Fairchild, 2700 W. 3rd St., Coal Valley, IL (US) 61240

( * ) Notice: Subject to any disclaimer, the term of this patent is extended or adjusted under 35 U.S.C. 154(b) by 241 days.

(21) Appl. No.: 11/638,948

(22) Filed: Dec. 14, 2006

(65) Prior Publication Data

US 2007/0275801 A1 Nov. 29, 2007

(51) Int. Cl.
*A63B 71/02* (2006.01)

(52) U.S. Cl. ..... 473/588

(58) Field of Classification Search ..... 473/588, 473/589

See application file for complete search history.

(56) References Cited

U.S. PATENT DOCUMENTS 3,102,727 A 9/1963 Rice
4,183,536 A 1/1980 Platt
4,846,475 A 7/1989 Newcomb et al.
4,968,036 A 11/1990 Von Der Mark
6,126,561 A 10/2000 Mark
6,645,097 B2 11/2003 Samuel et al.
7,066,851 B1 6/2006 Poruchny
2004/0220001 A1 11/2004 Oister et al.

FOREIGN PATENT DOCUMENTS

CA 2415980 A1 7/2004
DE 29603817 U1 8/1996

*Primary Examiner*—Raleigh W. Chiu
(74) *Attorney, Agent, or Firm*—Hamilton IP Law, PC; Jay R. Hamilton; Charles A. Damschen

(57) ABSTRACT

A hockey puck comprised of an annular member with a translucent member disposed interior to the annular member. The interface of the annular member and the translucent member is reflective. A light member is disposed in the translucent member to form a hockey puck having symmetrical contact surfaces. A plurality of raised nubs may be located on the first and second opposedly arranged surfaces (faces) of said annular member for playing on non-ice surfaces.

10 Claims, 10 Drawing Sheets

HOCKEY PUCK

FIELD OF INVENTION

A hockey puck useful for playing the game of hockey. More particularly, the hockey puck disclosed and claimed allows for play on ice and non-ice surfaces at night or in low light conditions.

CROSS REFERENCE TO RELATED APPLICATIONS

This non-provisional utility patent application claims priority from and incorporates in its entirety the contents of the non-provisional utility patent application previously filed on May 24, 2006 and assigned Ser. No. 11,440,586 by the United States Patent & Trademark Office.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

AUTHORIZATION PURSUANT TO 37 C.F.R. §1.171 (d)(c)

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

DETAILED DESCRIPTION—LISTING OF ELEMENTS

Figure 1:
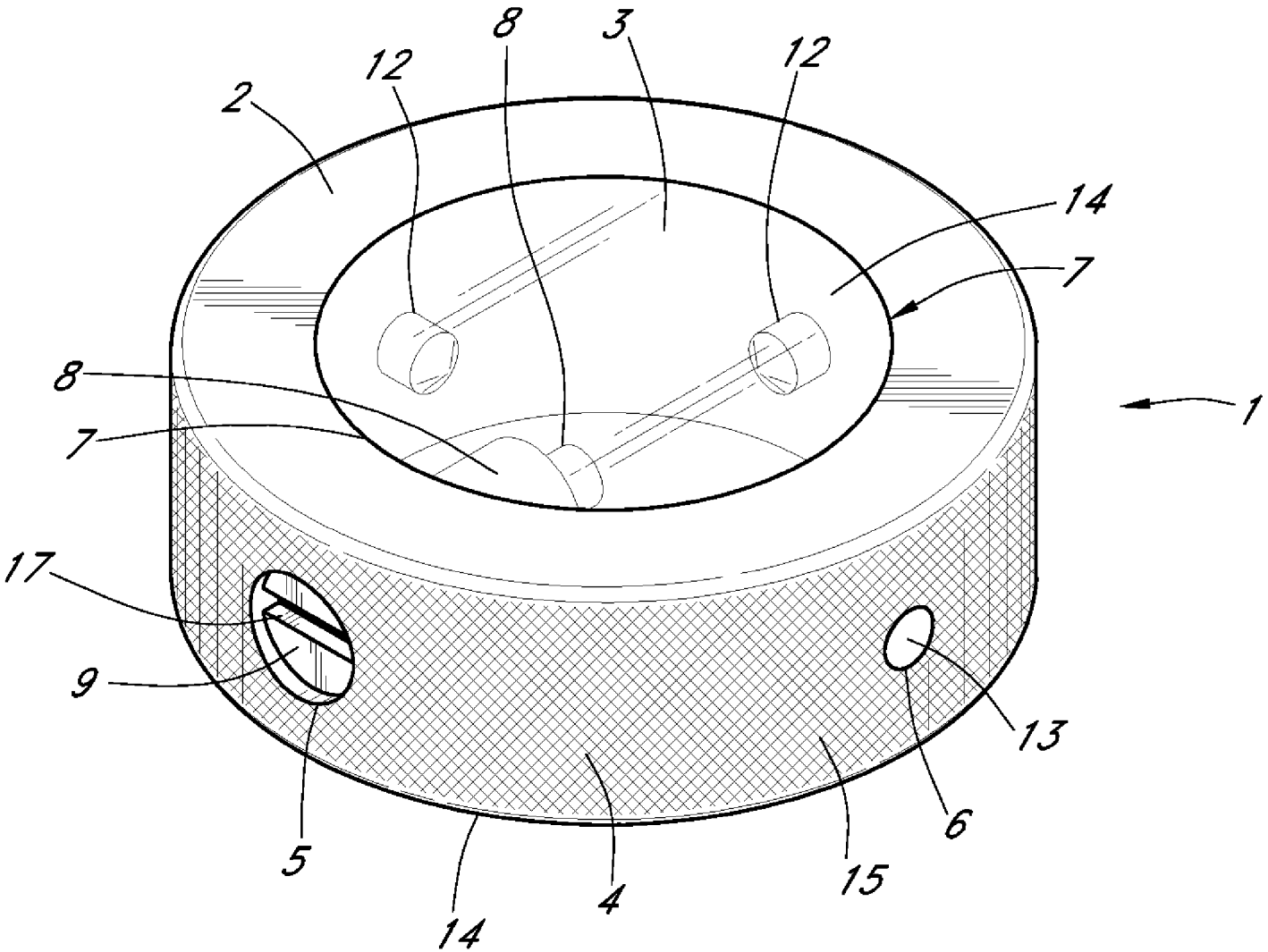
FIG. 1 is perspective view of an ice hockey puck according to an embodiment of the invention.

| ELEMENT DESCRIPTION | ELEMENT # |
|---|---|
| Ice hockey puck | 1 |
| Annular member | 2 |
| Translucent disc member | 3 |
| Annular member - edge | 4 |
| Radial bore - light member | 5 |
| Radial bore - light channel | 6 |
| Outer edge of translucent disk (reflective) | 7 |
| Light member | 8 |
| Light switch | 9 |
| Light emitting diode & socket | 10 |
| Battery | 11 |
| Light channel | 12 |
| Light channel - outlet | 13 |
| Playing surface(s) of ice hockey puck | 14 |
| Annular member edge "diamond" grooves | 15 |
| Housing | 16 |
| Light switch groove | 17 |
| Street hockey puck | 18 |
| Nub | 19 |
| Playing surface(s) of street hockey puck | 20 |

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

DETAILED DESCRIPTION

Referring now to the drawings, wherein like reference numerals designate identical or corresponding parts throughout the several views, wherein the present art is shown in FIG. 1-18.

FIG. 1 is perspective view of a first embodiment of the invention which is primarily for use as an ice hockey puck 1 for play on ice covered surfaces. As shown, the ice hockey puck 1 includes an annular member 2 formed from standard hockey puck materials, namely rubber compounds or the like. More specifically, the rubber compounds used are carbonized, also referred sometimes referred to as "vulcanized" by those skilled in the arts. The vulcanized rubber annular member 2 allows the ice hockey puck 1 to resist wear during play while allowing the annular member to absorb the energy delivered by contact with the hockey stick (not shown) and or the impact with the playing surfaces with a minimum of deflection to minimize hockey puck bounce. A translucent or transparent disk member 3, formed from polycarbonate or other suitable materials, such as LEXAN®, a General Electric branded polycarbonate resin thermoplastic, is press fit within annular member 2 to form the complete ice hockey puck 1, of regular conformation and weight for league play.

As manufactured, the outer edge 7 of the translucent member, at the interface of the annular member 2 and the translucent disc member 3, is reflective. The reflective nature of this edge allows full distribution and transmission of the light produced. It will be apparent to those skilled in the arts that a small amount of clear glue may be added, as needed, at the interface of the annular member 2, the reflective edge 7 and the translucent disk member to solidify and stabilize the ice hockey puck 1.

Regulation National Hockey League (NHL) pucks must be three inches (7.6 cm) in diameter and one inch (2.54 cm) thick. The allowable weight range is 5.5-6 ounces (154-168 g). The outside edge 4 of the annular member 2 typically has a series of "diamonds," which are slightly raised bumps or grooves 15. The diamonds 15 give a taped hockey stick something to grip when the ice hockey puck 1 is shot (not shown). The hockey pucks used in junior hockey are sometimes only 4 oz (143 g). It is within the scope of applicant's invention to embody the invention to meet the requirements of either league. As is known to those that play or watch hockey, during a game, each team will typically keep a supply of hockey pucks in a freezer at all times. During hockey games, hockey pucks are kept frozen in an ice packed cooler, which usually sits on the officials' bench. All ice hockey pucks are frozen to reduce the amount of bounce of the hockey puck, as preferred by those playing and holding the games.

The annular member 2 has at least two radial bores placed therein. Although not shown, up to eight radial bores may be placed therein. Applicant testing has determined that the preferred number is four (4) radial bores. The first radial bore 5 is larger and allows insertion of light member 9, described in more detail at FIG. 8 and FIG. 9. The other radial bore(s) 6 are smaller and have a light channel 12 inserted therein. When the light member 9 is engaged, light is allowed to travel from the translucent inside of the ice hockey puck 1 to the exterior via and along the light channel 12 to the exterior of the ice hockey puck at the outlet of the light channel 13. The light channels 12 serve the dual functions of providing structural support to the annular member 2 and transparent disk 3 interface while allowing light to the exterior of the ice hockey puck.

Annular member 2 causes the ice hockey puck 1 to have the feel and performance of a regular hockey puck. The translucent/transparent disc member 3 with light member 9 provides illumination such that the ice hockey puck 1 may be employed to play hockey at night such as on ponds or the like, thereby making the game of hockey more accessible, particularly to those who do not have access to an indoor hockey rink facility, and furthermore, due to work or school schedules, cannot play hockey until twilight or nighttime hours. The lighted feature of the present invention also is a visual training aid which facilitates "heads up" training.

Figure 2:
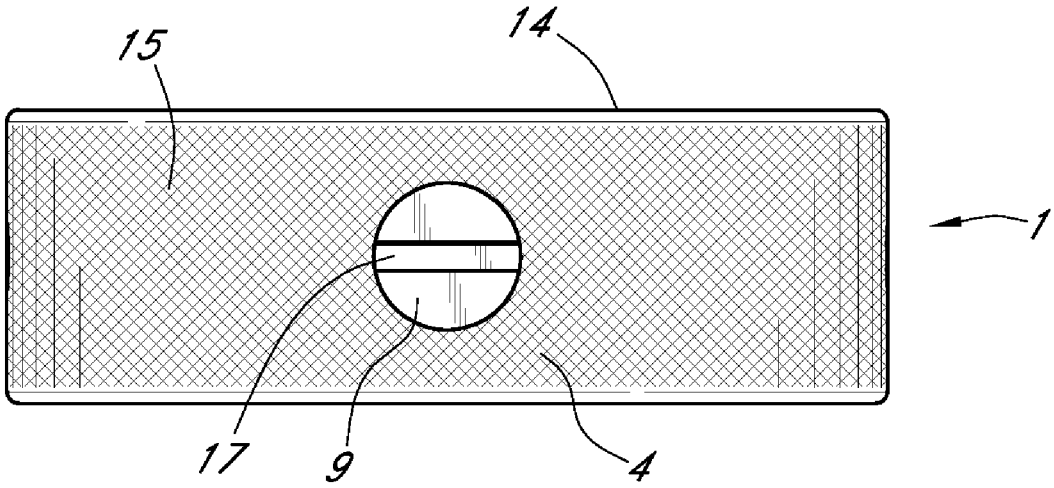
FIG. 2 is a first side view of an ice hockey puck according to an embodiment of the invention.
Figure 3:
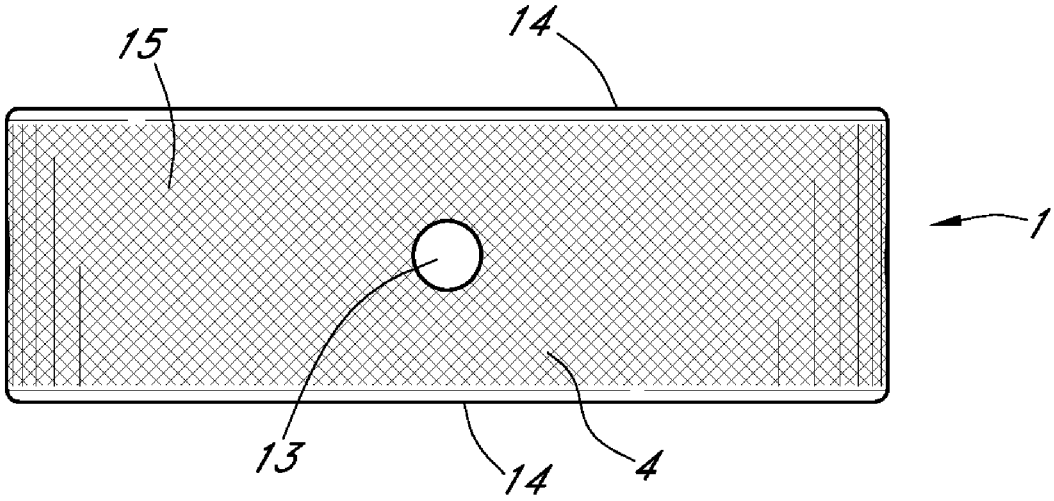
FIG. 3 is a second side view of an ice hockey puck according to an embodiment of the invention.

FIG. 2 is a first side view of the ice hockey puck 1 illustrating the light switch 9 of the light member 8 in relation to the annular member edge 4. The light switch 9 has a groove 17 allowing the light member to be engaged from the exterior of the ice hockey puck 1. FIG. 3 is a second side view of the ice hockey puck 1 illustrating the outlet of the light channel 12 in relation to the annular member edge 4.

Figure 4:
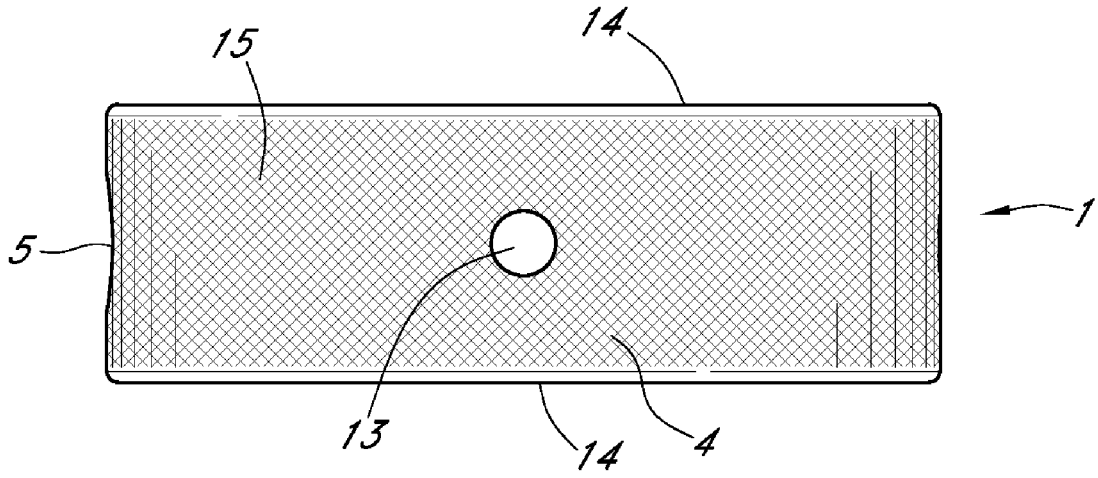
FIG. 4 is a third side view of an ice hockey puck according to an embodiment of the invention.
Figure 5:
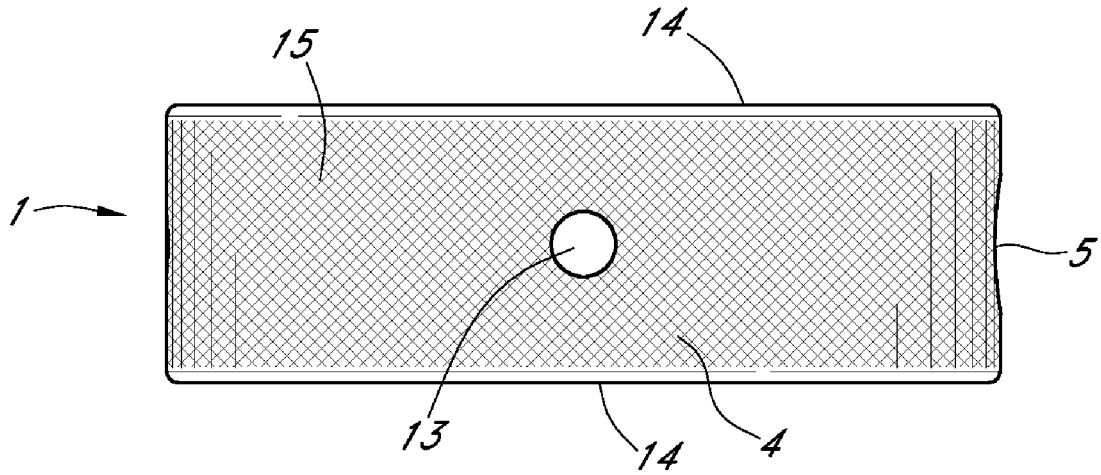
FIG. 5 is a fourth side view of an ice hockey puck according to an embodiment of the invention.

FIG. 4 is a third side view of the ice hockey puck 1 illustrating the light switch 9 of the light member 8 in relation to the annular member edge 4 and the outlet of a light channel 12. FIG. 5 is a fourth side view of the ice hockey puck 1 illustrating the light switch 9 of the light member 8 in relation to the annular member edge 4 and the outlet of a light channel 12.

Figure 6:
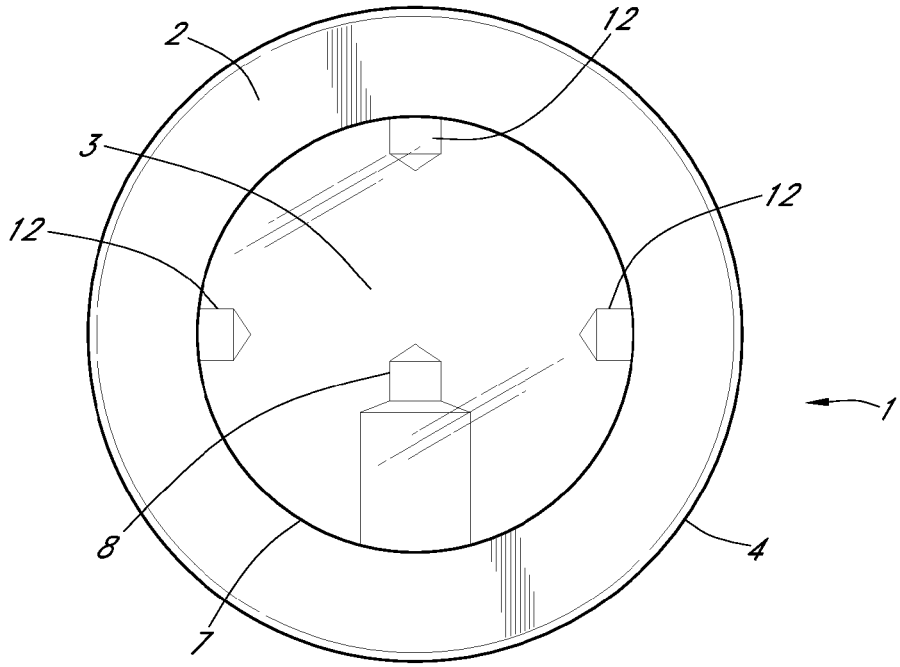
FIG. 6 is a top side view of an ice hockey puck according to an embodiment of the invention.
Figure 7:
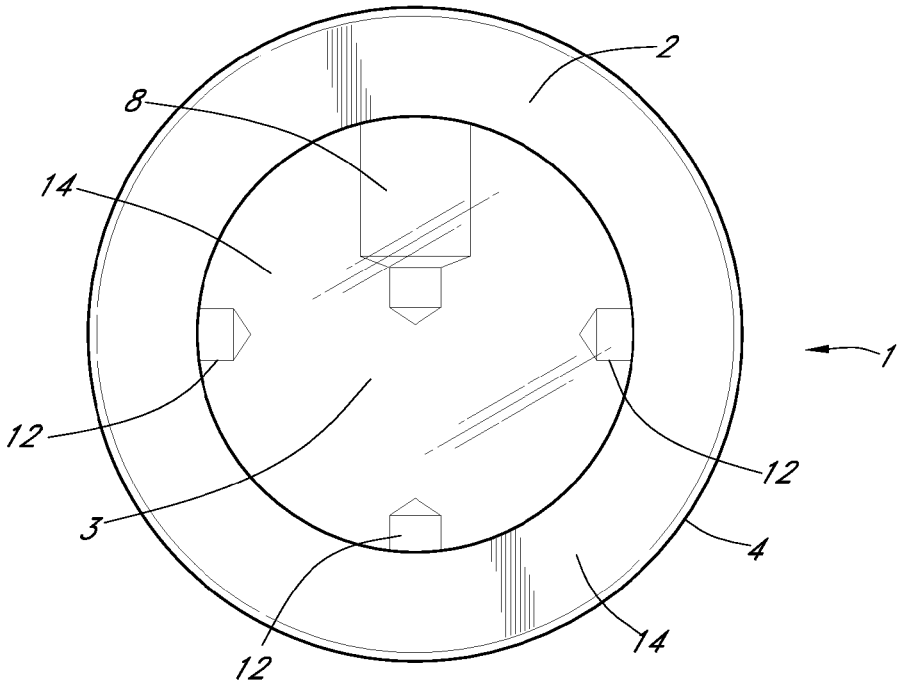
FIG. 7 is a bottom side view of an ice hockey puck according to an embodiment of the invention.

FIG. 6 is a top side view of the ice hockey puck 1 and FIG. 7 is a bottom side view of the ice hockey puck 1. The opposing playing surfaces of the ice hockey puck 14, presented as the top and bottom profiles of the ice hockey puck 1, are identical and symmetrical, so the terms top and bottom are chosen to distinguish and clarify the views shown. The symmetrical nature, however, of the ice hockey puck 1, as illustrated in the preceding FIGS. 2-7, provides a distinct advantage for an illuminated hockey puck. Because there is no top or bottom, the hockey puck may be dropped and played in any orientation. The light is transmitted from either face of the translucent disc member 3 which also serve to support and act as a portion of the playing surfaces 14. The symmetrical profile of the ice hockey puck 1 in combination with the reflective layer or ring 7 and light channel(s) 12 produces an illuminated ice hockey puck having the look and feel of a non-illuminated hockey puck to meet the needs and or requirements of hockey players.

Figure 8:
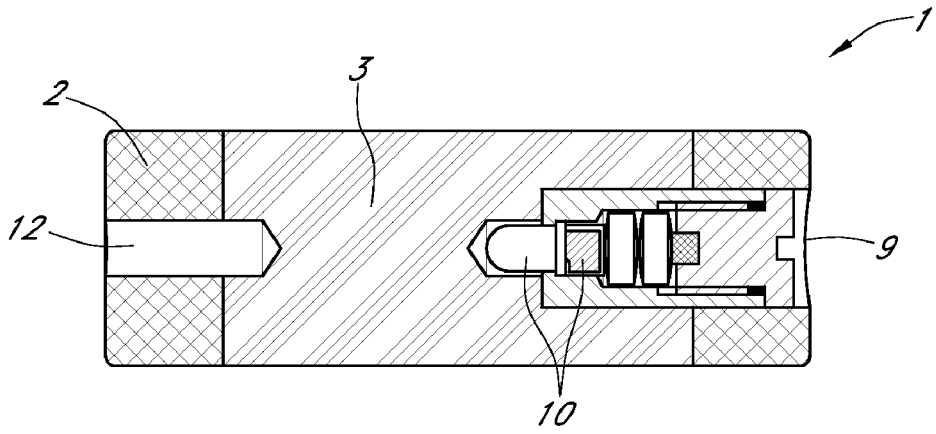
FIG. 8 is a side view of an ice hockey puck with a detailed illustration of the light member.
Figure 9:
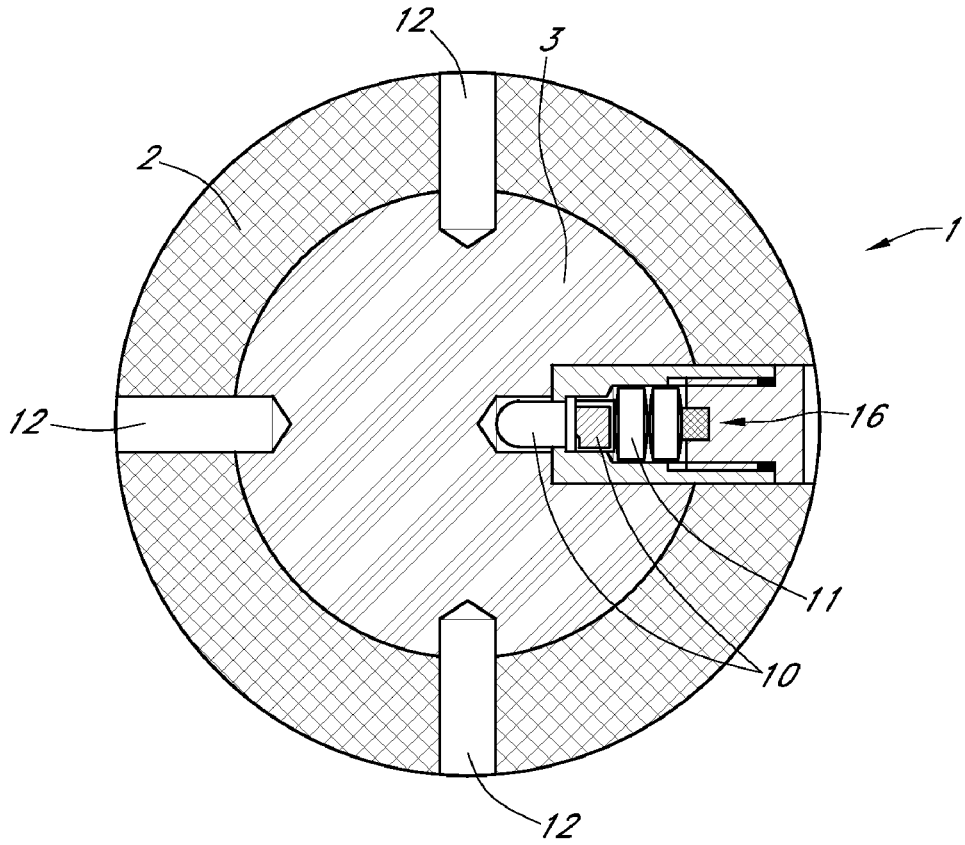
FIG. 9 is a top side view of an ice hockey puck with a detailed illustration of the light member.

FIG. 8 and FIG. 9 provide detailed views of the light member 8 of the ice hockey puck 1. The light member 8 may be comprised of a light emitting diode (LED) and socket 10 which is removably insertable within the larger radial bore 5 within the housing 16. A battery 11 also fits within the larger radial bore 5 with housing 14 adjacent LED and socket 10. A light switch 9, which in this embodiment is a set screw/on-off switch, causes engagement of the battery 11 with the light member 8 thereby illuminating the ice hockey puck 1. Light switch 9 may be turned on from the exterior of the ice hockey puck 1 using light switch groove 17 and has minimal impact upon on the profile of the ice hockey puck as previously shown at FIGS. 4 and 5. Although not shown, it will be apparent to those skilled in the arts that other type of lighting and switch mechanisms may be employed without limiting the scope of the present disclosure.

Figure 10:
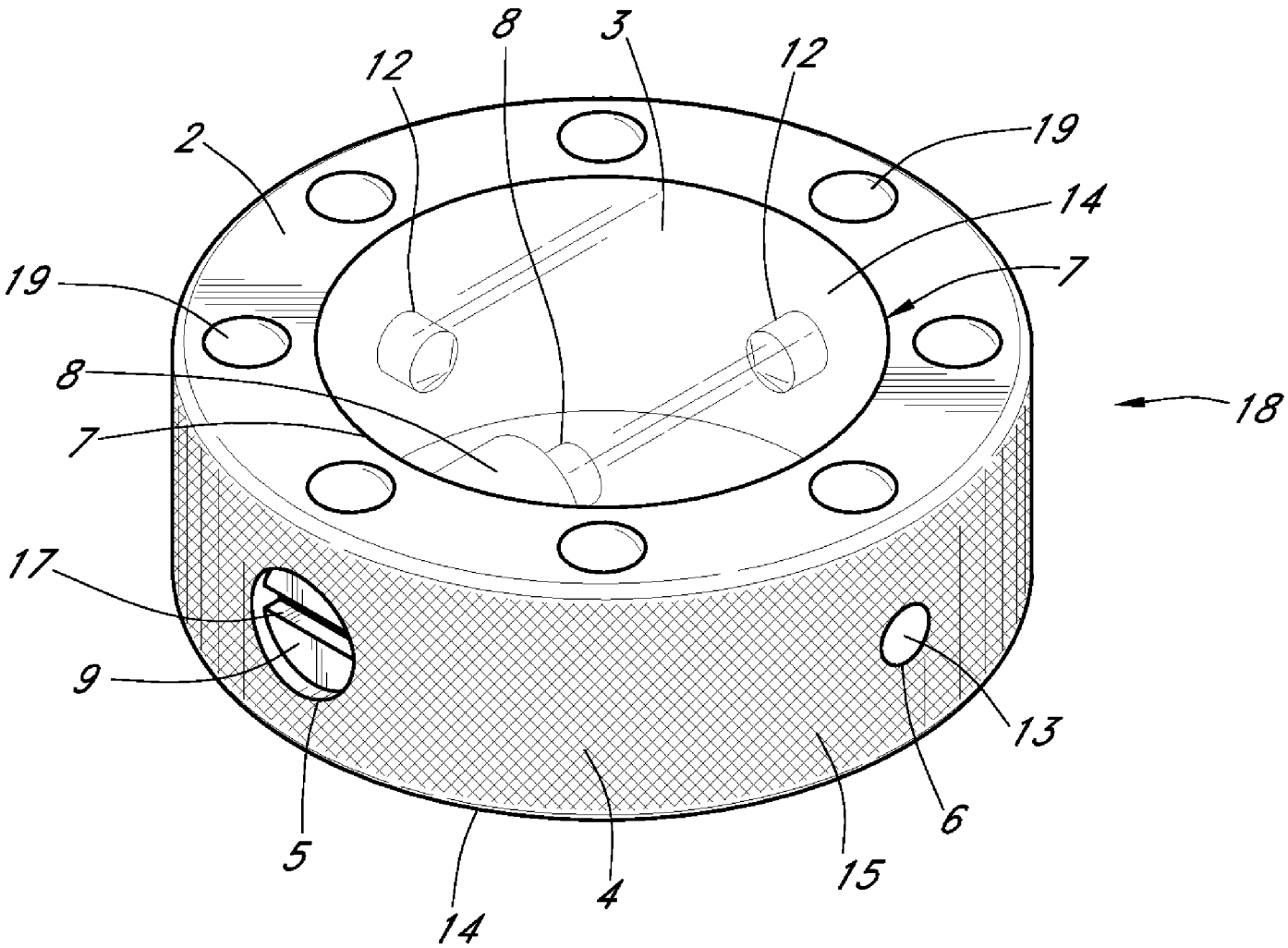
FIG. 10 is perspective view of a street hockey puck according to a second embodiment of the invention.

FIG. 10 is perspective view of a second embodiment of the invention which is primarily for use as a non-ice or street hockey puck 18 for play on non-ice covered surfaces. As shown, the street hockey puck 19 also includes an annular member 2 formed from standard hockey puck materials, namely rubber compounds or the like. As previously discussed, the vulcanized rubber annular member 2 allows the street hockey puck 1 to resist wear during play while allowing the annular member 2 to absorb the energy delivered by contact with the hockey stick (not shown) and or the impact with the playing surfaces with a minimum of deflection to minimize hockey puck bounce. As shown particularly in FIG. 10, the street hockey puck embodiment of the present invention has a plurality of nubs 19 positioned on the opposedly faced playing surfaces of the street hockey puck 20.

Similar to the ice hockey puck, a translucent disk member 3, also formed from polycarbonate or other suitable materials, such as LEXAN®, is press fit within annular member 2 to form the complete street hockey puck 18. As manufactured, the outer edge 7 of the translucent member, at the interface of the annular member 2 and the translucent disc member 3, is reflective. The reflective nature of this edge 7 allows full distribution and transmission of the light produced. It will be apparent to those skilled in the arts that a small amount of clear glue may be added, as needed, at the interface of the annular member 2, the reflective edge 7 and the translucent disk member to solidify and stabilize the street hockey puck 18.

The outside edge 4 of the annular member 2 typically has a series of "diamonds," which are slightly raised bumps or grooves 15. The diamonds 15 give a taped hockey stick something to grip when the street hockey puck 1 is shot (not shown). The annular member 2 of the street hockey puck also has at least two radial bores placed therein. Although not shown, up to eight radial bores may be placed therein. Applicant testing has determined that the preferred number is four (4) radial bores, as shown in FIG. 1-18. The first radial bore 5 is larger and allows insertion of light member 9, described in more detail at FIG. 17 and FIG. 18. The other radial bore(s) 6 are smaller and have a light channel 12 inserted therein. When the light member 9 is engaged, light is allowed to travel from the translucent inside of the street hockey puck 18 to the exterior via and along the light channel 12 to the exterior of the street hockey puck at the outlet of the light channel 13. The light channels 12 serve the dual functions of providing structural support to the interface of the annular member 2 and transparent disk 3 while allowing light to the exterior of the street hockey puck 18.

Annular member 2 causes the ice hockey puck 1 to have the feel and performance of a regular street hockey puck. The translucent/transparent disc member 3 with light member 9 provides illumination such that the street hockey puck 18 may be employed to play hockey at night on basketball courts and parking lots or the like, thereby making the game of hockey more accessible, particularly to those who do not have access to an indoor hockey rink facility, and furthermore, due to work or school schedules, cannot play hockey until twilight or nighttime hours. The lighted feature of the present invention also is a visual training aid which facilitates "heads up" training.

Figure 11:
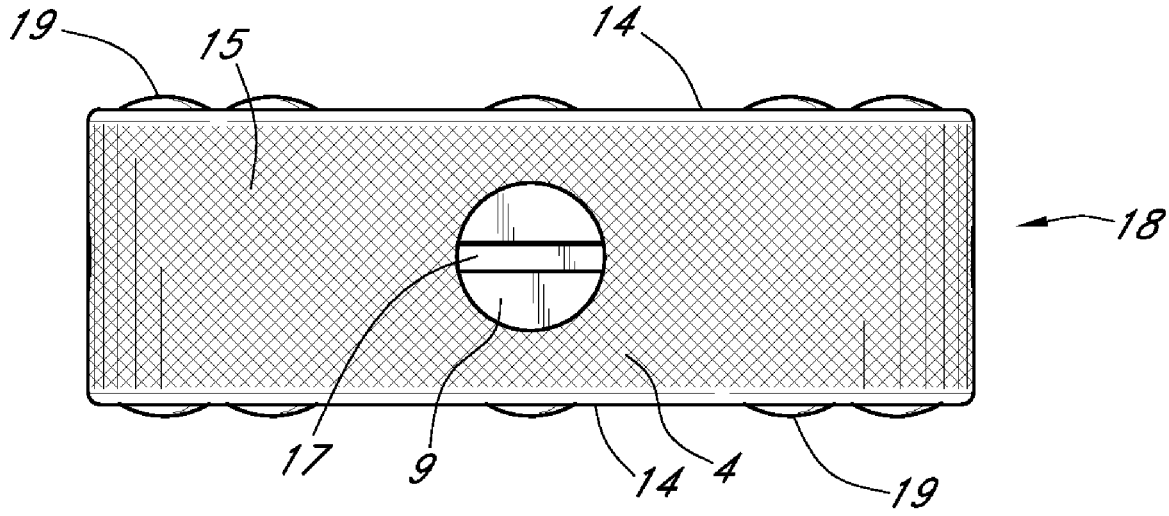
FIG. 11 is a first side view of a street hockey puck according to a second embodiment of the invention.
Figure 12:
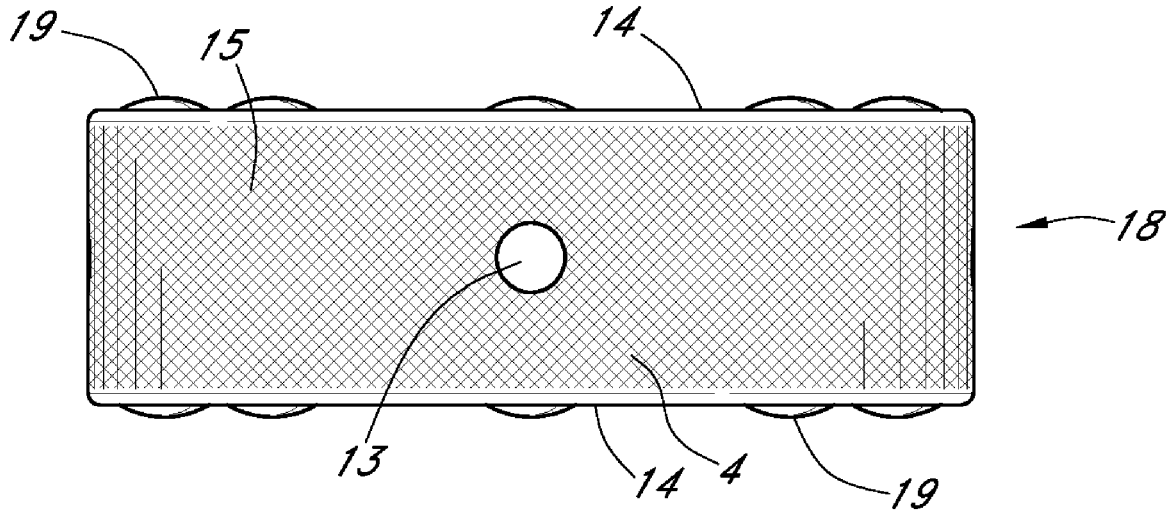
FIG. 12 is a second side view of a street hockey puck according to a second embodiment of the invention.

FIG. 11 is a first side view of the street hockey puck 1 illustrating the light switch 9 of the light member 8 in relation to the annular member edge 4. The light switch 9 has a light switch groove 17 allowing the light member 8 to be engaged from the exterior of the street hockey puck 18. FIG. 12 is a second side view of the street hockey puck 1 illustrating the outlet of the light channel 12 in relation to the annular member edge 4.

Figure 13:
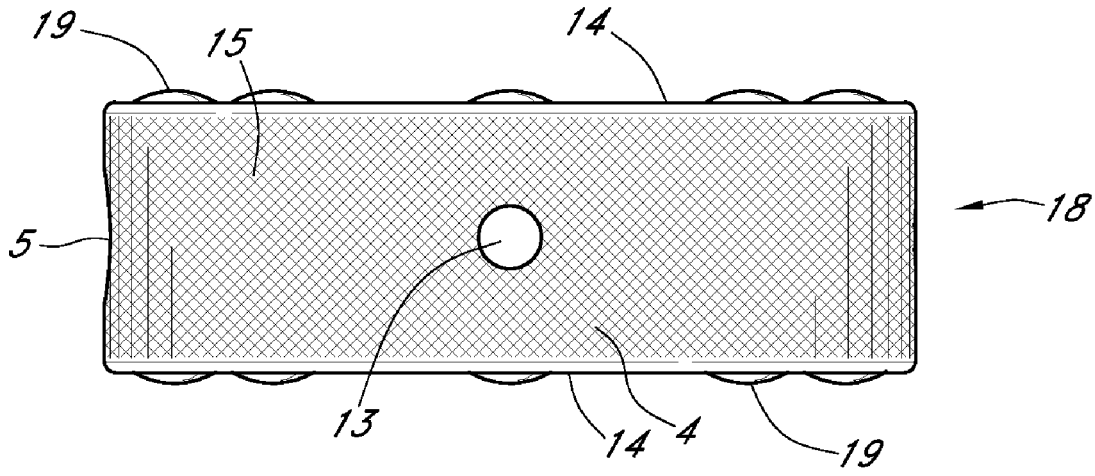
FIG. 13 is a third side view of a street hockey puck according to a second embodiment of the invention.
Figure 14:
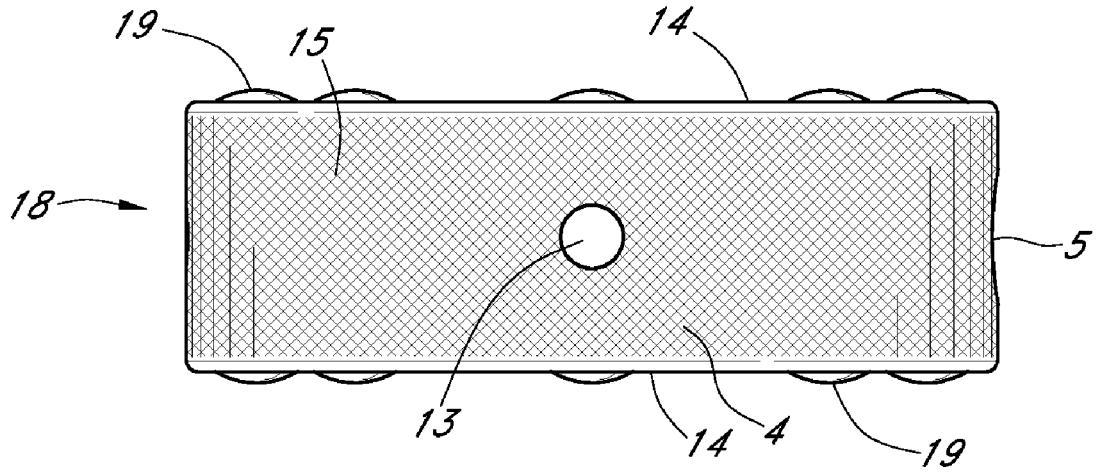
FIG. 14 is a fourth side view of a street hockey puck according to a second embodiment of the invention.

FIG. 13 is a third side view of the street hockey puck 1 illustrating the light switch 9 of the light member 8 in relation to the annular member edge 4 and the outlet of a light channel 12. FIG. 14 is a fourth side view of the street hockey puck 1 illustrating the light switch 9 of the light member 8 in relation to the annular member edge 4 and the outlet of a light channel 13.

Figure 15:
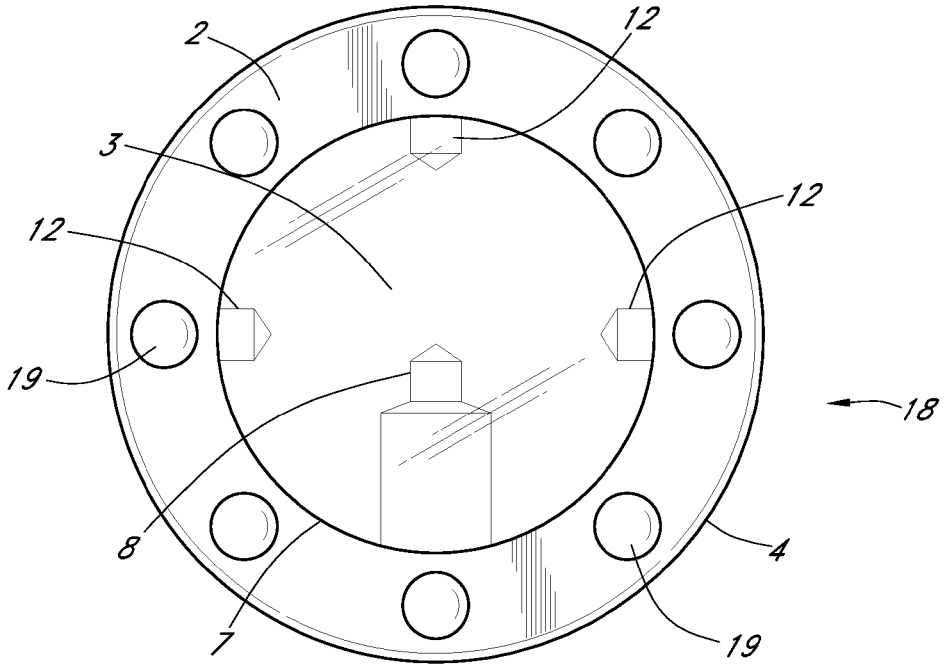
FIG. 15 is a top side view of a street hockey puck according to a second embodiment of the invention.
Figure 16:
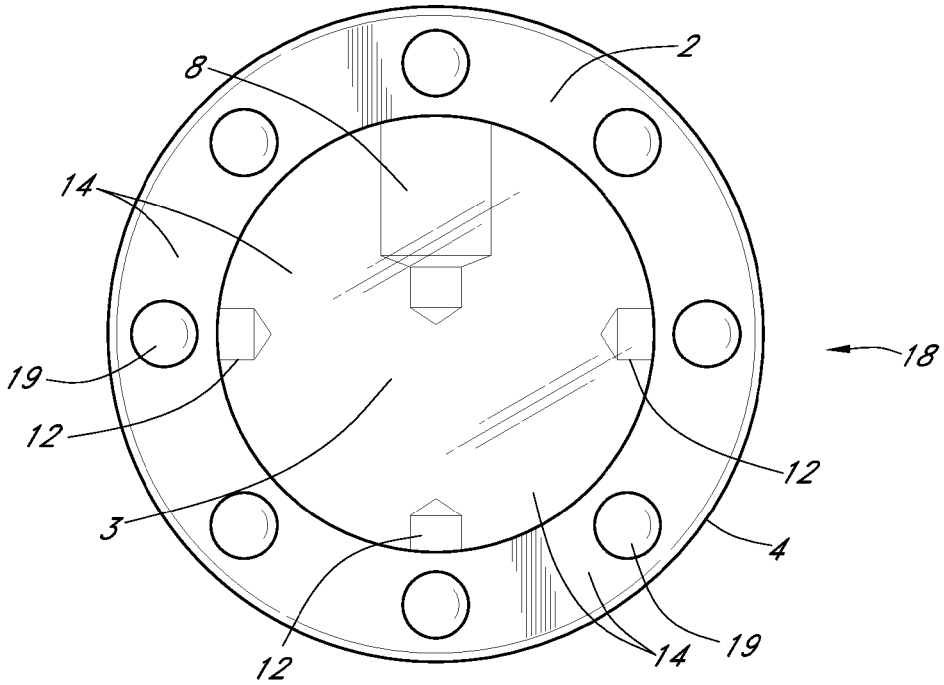
FIG. 16 is a bottom side view of a street hockey puck according to a second embodiment of the invention.

FIG. 15 is a top side view of the street hockey puck 18 and FIG. 16 is a bottom side view of the street hockey puck 18. The opposing playing surfaces of the ice hockey puck 14, presented as the top and bottom profiles of the street hockey puck 18, are identical and symmetrical, so the terms top and bottom are chosen to distinguish and clarify the views shown. The symmetrical nature, however, of the street hockey puck 18, as illustrated in the preceding FIGS. 10-14, provides a distinct advantage for an illuminated street hockey puck. Because there is no top or bottom, the street hockey puck may be dropped and played in any orientation. The light is transmitted from either face of the translucent disc member 3 which also serve to support and act as a portion of the playing surfaces 14. The symmetrical profile of the street hockey puck 1 in combination with the reflective layer or ring 7 and light channel(s) 12 produces an illuminated street hockey puck having the look and feel of a non-illuminated street hockey puck to meet the needs and or requirements of hockey players.

Figure 17:
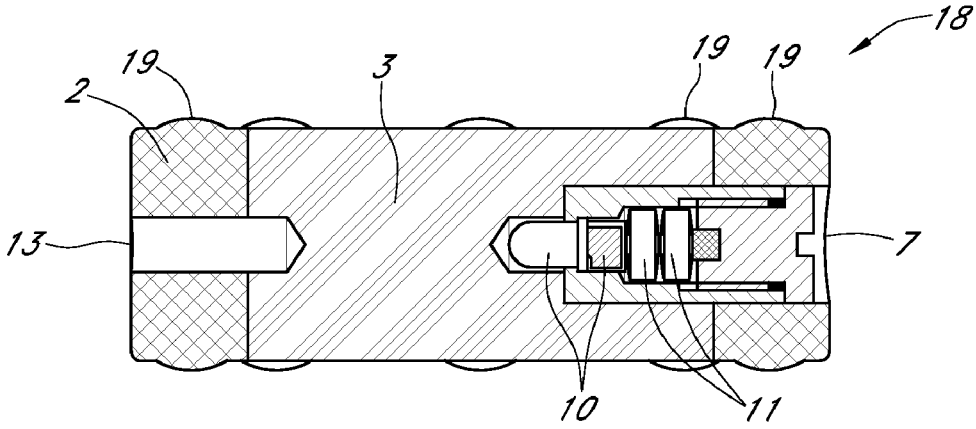
FIG. 17 is a side view of a street hockey puck according to a second embodiment of the invention.
Figure 18:
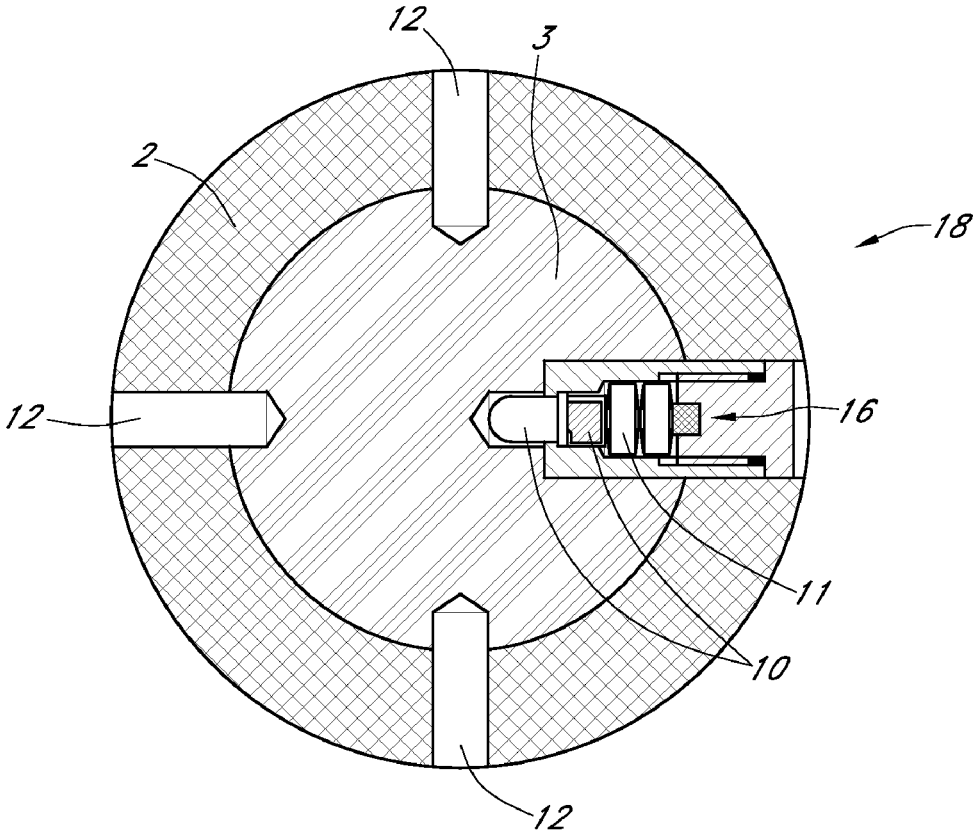
FIG. 18 is a top side view of a street hockey puck according to a second embodiment of the invention.

FIG. 17 and FIG. 18 provide detailed views of the light member 8 of the ice hockey puck 1. The light member 8 may be comprised of a light emitting diode (LED) and socket 9 which is removably insertable within the larger radial bore 5 within the housing 16. A battery 11 also fits within the larger radial bore 5 with housing 14 adjacent LED and socket 9. A light switch 9, which in this embodiment is a set screw/on-off switch, causes engagement of the battery 11 with the light member 9 thereby illuminating the ice hockey puck 1. Light switch 9 may be turned on from the exterior of the ice hockey puck 1 using light switch groove 17 and has minimal impact upon on the profile of the ice hockey puck as previously shown at FIGS. 15 and 16. Although not shown, it will be apparent to those skilled in the arts that other type of lighting and switch mechanisms may be employed without limiting the scope of the present disclosure.

It should be noted that the present invention is not limited to the specific embodiments pictured and described herein, but is intended to apply to all fence rail retractors. Modifications and alterations from the described embodiments will occur to those skilled in the art without departure from the spirit and scope of the present invention.

The invention claimed is:

1. A hockey puck comprising:

a. an annular member, said annular member having a first surface and a second surface, wherein said first and second annular member surfaces are oppositely positioned to form an annular member edge, said annular member edge having an interior and exterior, said annular member edge perpendicular to said first and second annular member surfaces;

b. a translucent member disposed interior to said annular member, wherein said translucent member has a first surface and a second surface, wherein said first and second translucent member surfaces are oppositely positioned to form a translucent member edge, wherein said translucent member edge is perpendicular to said first and second translucent member surfaces and is positioned adjacent said interior of said annular member edge, to form an interface between said annular member and said translucent member edge is light reflective, c. a plurality of radial bores, said plurality of radial bores placed in and through said annular member into said translucent member;

d. at least one light channel, said at least one light channel positioned in at least one of said plurality of radial bores; and, e. a light member disposed in at least of said radial bores to form a hockey puck having symmetrical contact surfaces.

2. The hockey puck of claim 1 wherein at least one said light channel is translucent and structurally supports and stabilizes the translucent member within the annular member.

3. The hockey puck of claim 2 wherein a plurality of raised nubs are located on said annular member edge.

4. The hockey puck of claim 1 wherein said light member includes a power switch, a power source and a light bulb.

5. The hockey puck of claim 1 wherein said light member includes a light emitting diode (LED).

6. The hockey puck of claim 1 wherein said annular member is formed of carbonized rubber.

7. The hockey puck of claim 1 wherein said translucent member is formed of a polycarbonate resin thermoplastic material.

8. The hockey puck of claim 1 wherein a plurality of raised nubs are located on said first and second annular member surfaces.

9. The hockey puck of claim 1 wherein said light member gives off colored light.

10. The hockey puck of claim 1 wherein the diameter of said plurality of radial bores varies.

* * * * *